US005833238A

United States Patent [19]

Watanabe

[11] Patent Number: 5,833,238

[45] Date of Patent: Nov. 10, 1998

[54] BOARD GAME SYSTEM AND PROCESS

[76] Inventor: Masato Watanabe, 147-4, Arahata, Tokorozawa-shi, Saitama 359, Japan

[21] Appl. No.: 816,496

[22] Filed: Mar. 13, 1997

[51] Int. Cl.[6] ..... A63F 3/00

[52] U.S. Cl. ..... 273/236; 273/271; 273/237

[58] Field of Search ..... 273/236, 271, 273/275, 264, 237

[56] References Cited

U.S. PATENT DOCUMENTS 711,959 10/1902 Graham ..... 273/236
1,433,919 10/1922 Taketoshi ..... 273/236

FOREIGN PATENT DOCUMENTS 512541 9/1939 United Kingdom ..... 273/236

OTHER PUBLICATIONS

"Hex", The Way To Play, The Illustrated Encyclopedia of the Games of the World, Paddington Press Ltd., p. 57, 1975.
"There's a Brand New Board Game in Town: Pente", by Nick Adde, Fairfax Journal, pp. B1, B3, Nov. 3, 1981.

*Primary Examiner*—Benjamin H. Layno
*Attorney, Agent, or Firm*—Foley & Lardner

[57] ABSTRACT

A game is played on a board marked with a square array of horizontal and vertical rows of elemental squares. First and second players initially hold a set of first pieces such as black round pieces and a set of second pieces such as red round pieces, respectively. Each player alternately places a piece at an unoccupied square, trying to occupy all the locations of one horizontal or vertical row, to use up all the piece of the hand, and to capture more opponent's pieces. Each side can place a new piece if the new piece is horizontally or vertically adjacent to a comrade piece on the board. If the new piece is horizontally or vertically adjacent to an enemy piece on the board, the new piece and the adjacent enemy piece are replaced. Pieces are captured if is they are completely enclosed and there are no adjacent unoccupied locations.

18 Claims, 8 Drawing Sheets i
j

BOARD GAME SYSTEM AND PROCESS

BACKGROUND OF THE INVENTION

The present invention relates to novel board game process, system and set for a fresh and exciting board game that is easy to play, but profound in strategy.

There are a wide variety of board games. However, some are difficult to play, and some are no longer fresh and exciting.

SUMMARY OF THE INVENTION

It is an object of the present invention to provide game process, system and set for easy, fresh, exciting board games for two or more players.

The rules of the game of the present invention are simple, but the profundity increases as the game proceeds. The game is intellectual and somewhat similar to "go", but the game of the present invention requires utterly different strategy. The result of the game is unpredictable. A one-sided winning game might end up in come-from-behind defeat.

According to the present invention, a playing process comprises:

a preparing step for preparing a game board marked with a rectangular array including horizontal and vertical rows of locations (such as elemental squares), and for dealing a first hand including a predetermined first set of playing pieces of a first type (such as black round pieces or stones) to a first player's side and a second hand including a predetermined second set of playing pieces of a second type (such as red round pieces or stones) to a second player's side; and a playing step for alternately allowing the first and second player's sides to place one piece at one of the locations on the board if a newly placed piece and a piece on the board are identical in type and adjacent to each other in one of the horizontal and vertical rows.

The process may further comprise a judging step for judging one side to be a first goal winner if one of the rows is occupied entirely by pieces of the one side.

A game board system according to illustrated embodiments of the present invention comprises:

a first section for making visible a game board marked with a rectangular array including horizontal and vertical rows of locations (such as squares), a first hand including a first set of first type playing pieces for a first player side and a second hand including a predetermined second set of second type playing pieces for a second player side; and a second section for repeating a cycle comprising a first operation for allowing the first side to place one of the pieces of the first hand at an empty one of the locations of the rectangular array on the board if the piece placed by the first side is in a connected state and a second operation for allowing the second side to place one of the pieces of the second hand at an empty one of the locations of the rectangular array on the board if the piece placed by the second side is in the connected state, and for judging one side to be a first goal winner if one of the horizontal and vertical rows is occupied entirely by pieces of the one side. In this system, each of two pieces on the board are in the connected state if the locations occupied by the two pieces are adjacent to each other in one of the horizontal and vertical rows and the two pieces are of one of the first and second types.

DETAILED DESCRIPTION OF THE INVENTION

Figure 1:
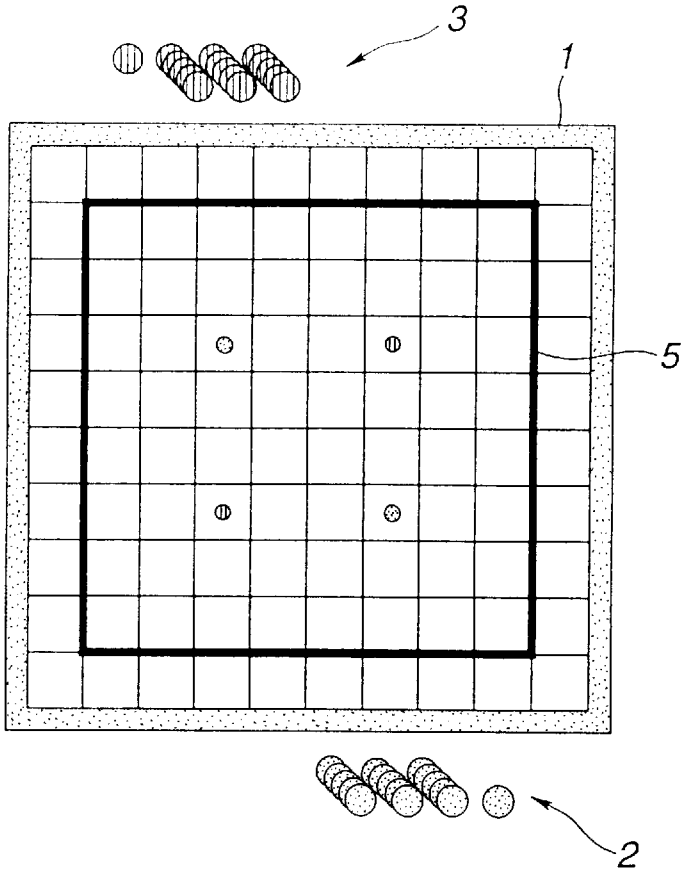
FIG. 1 is a plan view of a game board according to a first embodiment of the present invention.

FIG. 1 shows a board game set according to a first embodiment of the present invention. A board game of this embodiment is played by two sides. When each side includes only one player, the game is a two-player game. In the two-player game, the first side is the first player who plays first, and the second side is the second player who plays next. This game can be played by four players in such a manner that each side is a team of two players. In this case, the first side is a first team including first and second players, and the second side is a second team including first and second players.

The board game set shown in FIG. 1 includes a game board 1, a first set of pieces (or stones) of a first type 2 or 3 and a second set of pieces (or stones) of a second type 3 or 2.

Before starting a game, each side places at least one piece on the board. The order of players is determined by a paper-stone-scissors game, or tossing a coin or some other appropriate way. The players place a piece in turn in the clockwise order. Each player passes when he or she cannot place a piece on the board and the opponent (or the next player) can place a piece on the board. This game does not limit the number of passes each player can declare. Each play can forgo the opportunity to place a piece on the board as many times as one desires. The game ends when a predetermined condition is reached to determine a winner or to draw the game.

The game board 1 has an upper surface marked with a rectangular array of locations each of which is adapted to receive only one piece. In this example, each location is defined by a rectangular cell, but it is optional to define the locations by intersections of horizontal and vertical lines. The rectangular array is in the form of an m×n matrix A including m horizontal rows and n vertical rows (or columns).

Each element of the matrix is a location for one piece, and a typical location Lij is the element in the ith horizontal row and jth vertical row where i is any whole number from 1 to m, and j is any whole number from 1 to n. In the example of FIG. 1, m=n, and the matrix is an n×n square matrix formed by horizontal straight lines and vertical straight lines, and each cell is a square.

The square array of this example is a 10×10 matrix including a hundred elements. A central 8×8 array is framed in an inner square frame 5 of solid lines. Players can select one of the 10×10 matrix and the 8×8 matrix.

In this example, the pieces of one type are black round pieces, and the pieces of the other type are red round pieces. One player's side is a black side or team, and the other side is a red side or team. The black piece set 2 of the black side includes 60 black pieces, and the red piece set 3 of the red side includes 60 red pieces. The first side who plays first initially holds 60 pieces of one type, and the second side who plays next initially holds 59 pieces of the other type in the case of a 10×10 matrix game. In the example of an 8×8 matrix game, the first side initially holds 40 pieces of one type, and the second side initially holds 39 pieces of the opposite type.

In the case of a four-player game, the piece set 2 or 3 of each side is divided into two equal halves, and the two players of each side initially receive two equal halves of the piece set 2 or 3 of the same side, respectively. The number of pieces initially held by a second player of the second side is smaller by one than the number of pieces initially held by a first player of the second side. In the case of the 10×10 matrix game, the first player of the second side initially holds 30 pieces of the second type and the second player of the second side initially holds 29 pieces of the second side. The second player of each side is a player who plays after the first player of the same side.

At least one of the locations is a first initial set location marked with a first type mark and at least one of the locations is a second initial set location marked with a second type mark. The number of the first initial set location or locations is equal to the number of the second initial set location or locations. Before starting a game, the first side places a piece of the first type at the first initial set location or each first initial set location, and the second side places a piece of the second type at the second initial set location or each second initial set location. In the example shown in FIG. 1, there are two of the initial set locations of the black side and two of the initial set locations of the second side. The two first side initial set locations are located at two diagonally opposite corner locations of a center 4×4 matrix, and the two second side initial set locations are the other diagonally opposite corner locations of the center 4×4 matrix. The locations L4,4 and L7,7 are the two initial set locations of the black side, and the locations L4,7 and L7,4 are the two initial set locations of the red side.

In the case of the four-player game, each of the four players places his or her piece at one of the initial set positions of the corresponding side.

Figure 2:
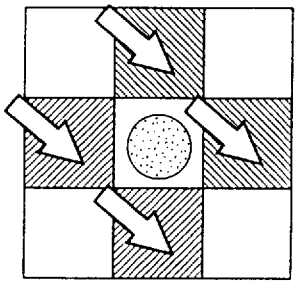
FIG. 2 is a schematic plan view of a 3×3 sample array in the board of FIG. 1 for illustrating a center location and four connectable neighboring locations.

FIG. 2 is a view of a 3×3 neighborhood matrix for illustrating the connectedness or connectivity of comrade pieces. In this neighborhood matrix, a center square or location is occupied by a black piece, and surrounded by four immediate neighbor locations and four diagonal neighbor locations. To facilitate understanding, FIG. 2 shows the four immediate neighbor locations or squares by hatching, and the four diagonal neighbor locations or squares without hatching. Two of the immediate neighbor locations are horizontal neighbor location and the remaining two immediate neighbor locations are vertical neighbor locations. The center location is between the two horizontal neighbor locations and these three locations are consecutive in one of the horizontal rows. Similarly, the center location and its two vertical neighbor locations on both sides are three consecutive locations in one of the vertical rows. The four immediate neighbor locations are the first nearest neighbors of the center location, and the diagonal neighbor locations are the second nearest neighbors.

When the center square is already occupied by a black piece and its four immediate neighbor locations are unoccupied, the black side can place a new black piece at one of the immediate neighbor squares. The newly placed piece is said to be connected to the piece at the center square if the new piece is placed at one of the four immediate neighbor squares and the new piece and the center piece are of the same type. The newly placed piece is not connected with the center piece of the same type at the center square if the new piece is placed at one of the diagonal neighbor locations. Each side can place a new piece from the hand if it is connected with a comrade piece of the same side already on the board.

Figures 3A, 3B, 4A, 4B, 4C:
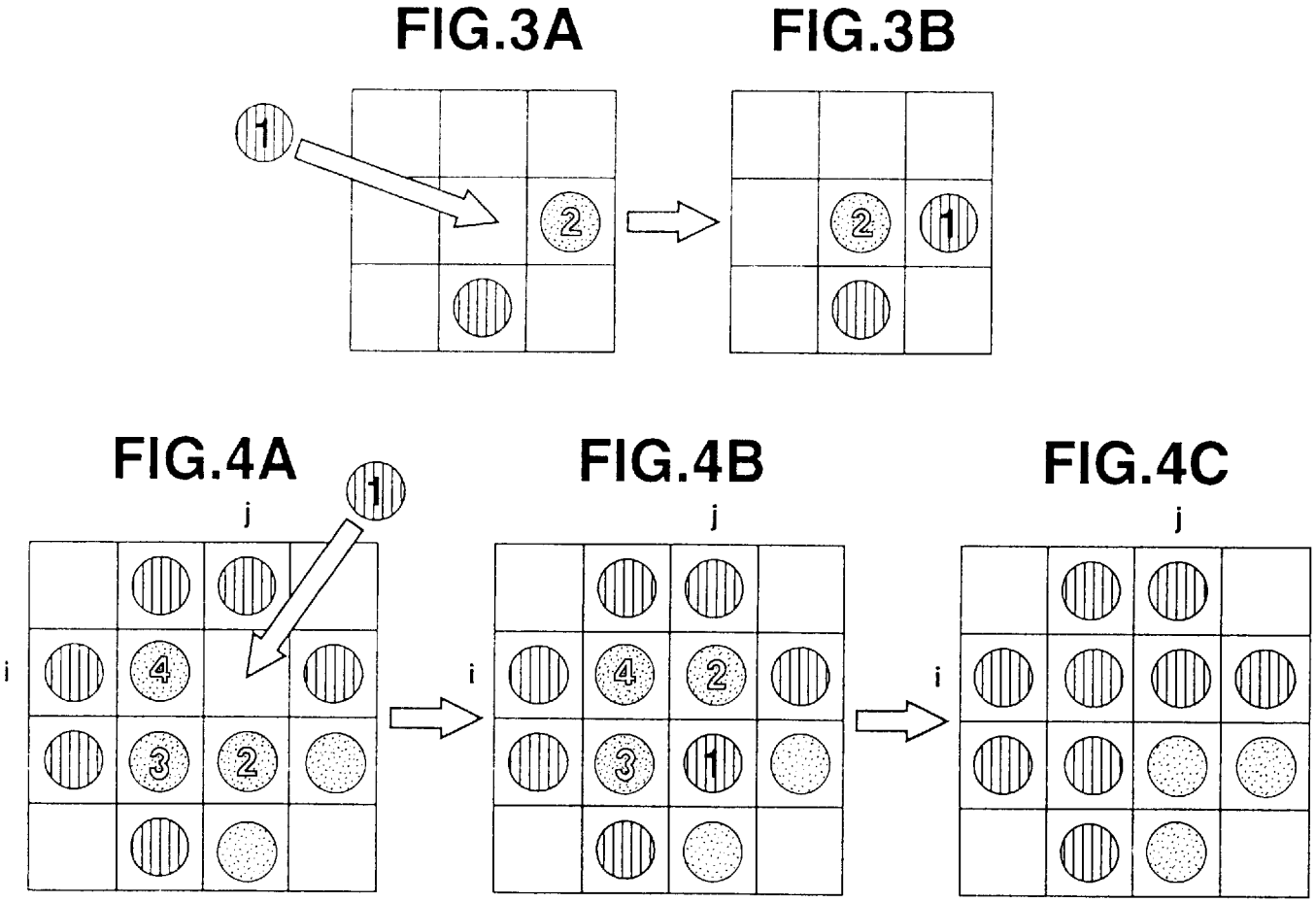
FIGS. 3A and 3B are schematic plan views for illustrating two adjacent opposing pieces and replacement of the two adjacent opposing pieces on the board of FIG. 1.
FIGS. 4A, 4B and 4C are schematic plan view for illustrating pieces enclosed by opponent's pieces on the board of FIG. 1.

FIGS. 3A and 3B illustrate the confrontation of opposing pieces. A newly placed piece is said to be in a confronted state if the newly placed piece is horizontally or vertically adjacent to an enemy piece of the opponent's side on the board. If the newly placed piece is in the confronted state with an enemy piece, both pieces must be replaced with each other, as shown in FIGS. 3A and 3B. In FIG. 3A, a new red piece is placed, as shown by an arrow, at a location which is horizontally adjacent to the location occupied by a black piece already on the board. In FIGS. 3A and 3B, the red and black pieces are marked with one and two, respectively, to avoid confusion. The red side can place the one-numbered red piece at the location indicated by the arrow in FIG. 3A because the one-number red piece is connected to a comrade red piece at the lower (or rear or north) adjacent location. On the other hand, the one-numbered red piece is confronted with the two-numbered black piece on the right or east side.

Therefore, the red side must necessarily exchange the positions of the one-numbered red piece and the two-numbered black piece as shown in FIG. 3B. If a newly placed piece is confronted with two or more enemy pieces, then the side of the newly placed piece can select one of the confronting enemy pieces and replace the newly placed piece with the selected enemy piece.

FIGS. 4A, 4B and 4C illustrate the enclosure of enemy pieces. In this example, the red side places a one-numbered red piece at a location Lij as shown by an arrow in FIG. 4A. The one-numbered red piece is in the confronted state with each of 2-numbered, 3-numbered and 4-numbered black pieces. In this example, the red side selects the 2-numbered black piece and replaces the one-numbered red piece and the 2-numbered black piece with each other as shown in FIG. 4B. In the state of FIG. 4B after the replacement, the 2-numbered, 4-numbered and 3-numbered black pieces are enclosed by 7 red pieces. Therefore, the red side captures these three black pieces, removes these black pieces from the board, and sets aside as captive pieces captured by the red side. Then, the red side refills the three locations from which the three black pieces are removed, by placing three red pieces of the hand of the red side at these three locations.

(In the case of the four-player game, the next player of the red side refills the three locations with pieces of his or her hand.) In the state of FIG. 4B, the 1-numbered red piece is also enclosed by the 3-numbered black piece on the left side and the non-numbered black piece on the right side, the 2-numbered black piece on the upper side and the non-numbered black piece on the lower side. Therefore, the black side can capture the 1-numbered red piece and refill the location by placing a new black piece in place of the captured 1-numbered red piece. The resulting state is shown in FIG. 4C. Thus, if one or more pieces of the first side are enclosed by pieces of the second side, and simultaneously one or more pieces of the second side are enclosed by pieces of the first side, then each side can capture the enclosed piece or pieces of the opposite side and refill the space with one's own piece or pieces.

Even if the refilling operation results in the state in which one or more pieces of one side are enclosed by piece of the other side, it is no longer allowed to capture the enclosed pieces. If an enclosure is broken and then one or more pieces of one side become enclosed again, then the other side can capture the re-enclosed pieces.

Figure 5A:
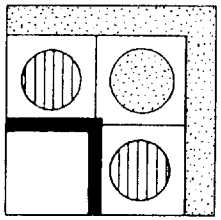
FIGS. 5A and 5B are schematic plan views for illustrating a piece enclosed at a corner and a piece enclosed along a boarder, respectively, on the board of FIG. 1.
Figure 5B:
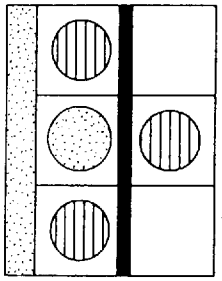

FIG. 5A shows a piece enclosed at a corner. FIG. 5B shows a piece enclosed along a border. In FIG. 5A, a black piece is at one of four corner locations of the matrix, and enclosed by one red piece at the horizontally adjacent location and another red piece at the vertically adjacent location. The red side can capture this black piece. In the 10×10 matrix, the four corner locations are L1,1; L1,10, L10,1 and L10,10. In FIG. 5B, a black piece is blocked on the left side by the outside border of the matrix, and enclosed by two red pieces on the upper and lower sides and another red piece on the right side. The red side can capture the black piece of FIG. 5B.

FIGS. 6A, 6B, 6C and 6D show examples of pieces that are surrounded by enemy pieces but uncapturable.

Figure 6A:
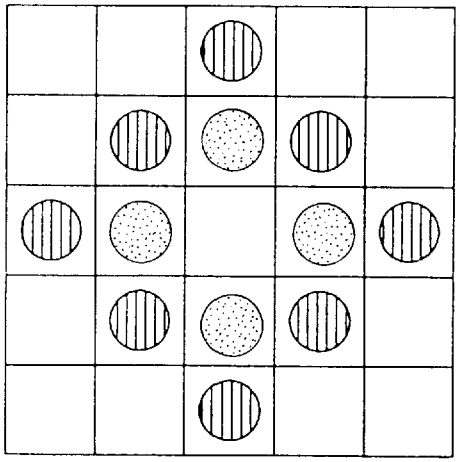
FIGS. 6A, 6B, 6C and 6D are schematic plan views for illustrating examples in which one side surrounds opponent's pieces on the board of FIG. 1, but the surrounding side cannot capture the opponent's pieces.

In FIG. 6A, four black pieces are surrounded by red pieces. However, there remains one unoccupied location enclosed by the four black pieces, and the red side can not place a new red piece at this unoccupied location because a red piece at this location cannot be connected to any of the red pieces on the board. In the example of FIG. 6A, each of the four black pieces is not connected but isolated from each other because of the emptiness of the center location.

Figure 6B:
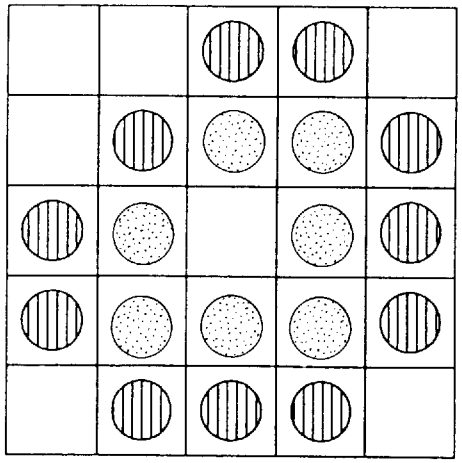

In FIG. 6B, seven black pieces are surrounded by red pieces. However, there remains one unoccupied location at which the red side can not place a red piece. Therefore, the red side cannot capture the black pieces. The seven black pieces of the example shown in FIG. 6B are connected with one another, and form a connected group.

Figure 6C:
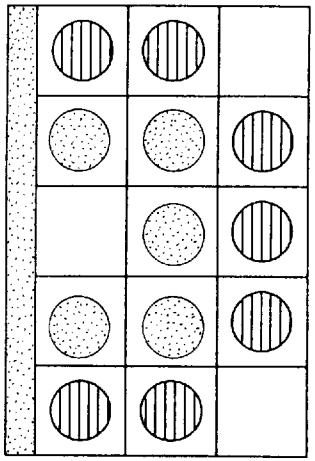

In FIG. 6C, too, five connected black pieces are uncapturable because one adjacent location is enclosed by these black pieces with the help of the border, and hence the red side cannot place a red piece there.

Figure 6D:
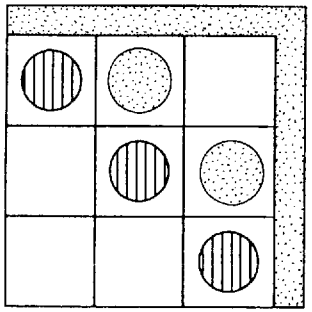

In FIG. 6D, the red side cannot capture two unconnected black pieces because the red side cannot place a red piece at the empty corner location blocked by the two black pieces.

In this way, each side can capture one or more opponent's pieces if the opponent's pieces are Unclosed by one's own pieces. Even though pieces of one side surround opponent's pieces, the one side cannot capture the surrounded opponent's pieces if there remains at least one location at which the one side cannot place one's own piece.

A winner is determined as follows.

If one side first occupies all the locations of at least one of the horizontal and vertical rows of the 10×10 or 8×8 matrix on the board, then the one side wins the game.

If the hand of one side first becomes empty, then the one side wins the game.

If both sides become unable to place a piece any more, the side holding more opponent's pieces as captives wins the game.

If one side occupies all the locations of at least one of the horizontal and vertical rows, and at the same time the hand of the other side becomes empty, then the side who has occupied all the locations of at least one row is the winner.

If both sides succeed simultaneously in occupying all the location of at least one row or if the hands of both sides become empty simultaneously, then the side holding more opponent's pieces as captives is the winner.

One side is the game winner if any one of the above-mentioned conditions is satisfied.

If both sides become unable to place a piece on the board, and the number of pieces captured by the first side is equal to the number of pieces captured by the second side, then the game ends in a draw.

If both sides succeed simultaneously in occupying all the location of at least one row, and the number of pieces captured by the first side is equal to the number of pieces captured by the second side, then the game ends in a draw.

If the hands of both sides become empty simultaneously, and the number of pieces captured by the first side is equal to the number of pieces captured by the second side, then the game ends in a draw.

Figure 7:
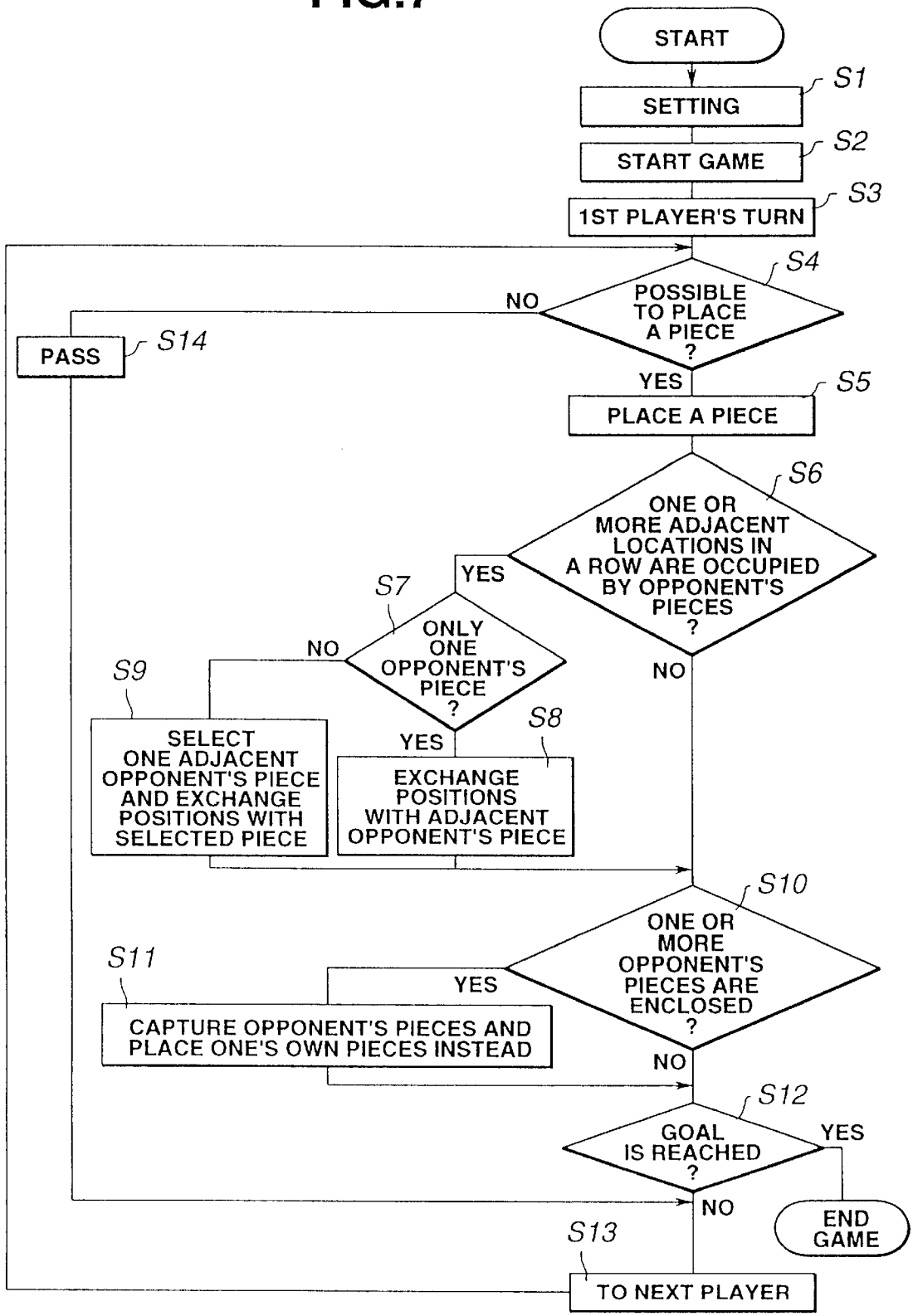
FIG. 7 is a flowchart showing a board game process according to a second embodiment of the present invention.

FIG. 7 shows a board game process according to a second embodiment of the present invention. The board game process of this example is performed by a control section 102 of a computer board game system shown in FIG. 8. In the second embodiment, the game board is an (electronic) image of the game board 1, and the playing pieces are (electronic) images of the playing pieces 2 and 3 which can be superimposed on the image of the game board on the screen of a display device.

At a step S1, the control section 102 allows players to determine the order (or sequence) of players, to select the designs of the board and pieces, and to select the size of the matrix (10×10 or 8×8, for example).

At a step S2, the control section 102 allows the players to start the game. At a step S3, the system determines that it is the first player's turn. For example, the control section 102 uses an order condition signal indicating the order of the players, and sets the order signal at a signal state designating the first player's turn.

At a step S4, the control section 102 determines whether it is possible to place a piece on the board. If the player designated by the order signal can place a piece on the board, the control section 102 allows the player to place a piece on the board at a step S5.

At a step S6, the control section 102 determines whether one or more of the vertically or horizontally adjacent locations are occupied by one or more opponent's pieces.

If at least one of the left and right adjacent locations and front and rear adjacent locations is occupied by at least one opponent's piece and hence the answer of the step S6 is affirmative, the control section 102 further determines at a step S7 whether there is only one opponent piece that occupies one of the vertically or horizontally adjacent locations. If the answer of the step S7 is affirmative, the control section 102 exchanges the positions of the newly placed piece and the adjacent opponent's piece. If two or more adjacent locations are occupied by opponent's pieces, and hence the answer of the step S7 is negative, then the control section 102 allows the player designated by the order signal to select one of the adjacent opponent's pieces and exchanges the positions of the newly placed piece and the selected opponent's piece.

A next step S10 is reached after the step S8 or S9 or if the answer of the step S6 is negative. At the step S10, the control section 102 determines whether pieces of one of the first and second sides enclose a piece or pieces of the other side. If there is at least one piece enclosed by enemy pieces of the enclosing side, then control section 102 allows, at a step S11, the enclosing side to capture the piece or pieces in the enclosed state, and to refill the location or locations with a piece or pieces of the enclosing side. The enclosing side can capture the enclosed opponent piece or pieces, remove the captured piece or pieces from the board as captives, and instead refill the vacated location or location with a piece or pieces from the hand of the enclosing side.

After the step S11, or if the answer of the step S10 is negative, the control section 102 proceeds to a step S12 and determines at the step S12 whether at least one of predetermined winning conditions is satisfied or not. If the answer of the step S12 is negative, the control section 102 proceeds to a step S13 to allow the next player to place a piece on the board, and returns to the step S4. For example, the control section 102 sets the order condition signal to a signal state designating the next player's turn at the step S13.

If the control section 102 determines at the step S4 that the side having a turn cannot place a piece on the board, then the system considers there to be a pass at a step S14, and further proceeds to the step S13.

At the step S12, the control section 102 determines if any one or more of the following five winning conditions are satisfied.

If one side occupies all the locations of at least one of the vertical and horizontal rows on the board, then the one side wins the game.

If the hand of one side first becomes empty, then the one side wins the game.

If both sides become unable to place a piece any more, the side holding more opponent's pieces as captives wins the game.

If one side occupies all the locations of at least one of the vertical and horizontal rows, and at the same time the hand of the other side becomes empty, then the side who has occupied all the locations of at least one row is the winner.

If both sides succeed simultaneously in occupying all the location of at least one row or if the hands of both sides become empty simultaneously, then the side holding more opponent's pieces as captives is the winner.

If the answer of the step S12 is affirmative, the control section 102 terminates the game.

Figure 8:
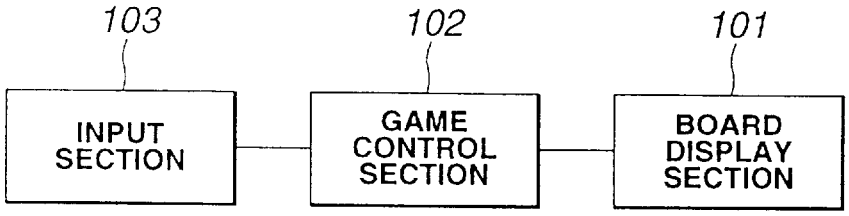
FIG. 8 is a block diagram showing a board game system according to the second embodiment.

As shown in FIG. 8, the board game system of this example comprises first, second and third sections 101, 102 and 103. In this example, the second section 102 is the above-mentioned control section. The first section 101 is a section for displaying the images of the game board, pieces, and other information, and allowing the superposition of images of pieces on the image of the board. The control section 102 is for controlling the first section 101. The control section 102 of the example has a computer such as a microcomputer, as a main component. The third section 103 is for allowing each player to command the control section 102 to place a piece on the board.

The first section 101 is an output section which, in this example, is a display section external to a computer. However, the first section 101 may be an output section of a computer for producing, storing and delivering picture signals to the external display device. The first section 101 of this example comprises a color display device. Instead, it is optional to employ a monochrome display device.

The third section 103 of this example is an input section adapted to be operated by the players. The input section 103 of this example comprises a mouse and a keyboard. Instead, the input section 103 may comprise a set of manual input devices for individual players especially when the system is in the form of a video game system. With the input section 103, each player can place a piece from the hand at a desired location on the board, and select one of opponent's pieces at the step S9.

The first, second and third sections 101, 102 and 103 may be separate units connected electrically with one another or may be incorporated in a single unit. The size of the system may be of a desktop size, a notebook size, a hand-held size or a pocket size, for example.

The display device of this example shows the board at the center of the screen, the playing pieces of the first player's hand on one side of the board, and the playing pieces of the second player's hand on the other side of the board.

Figure 9:
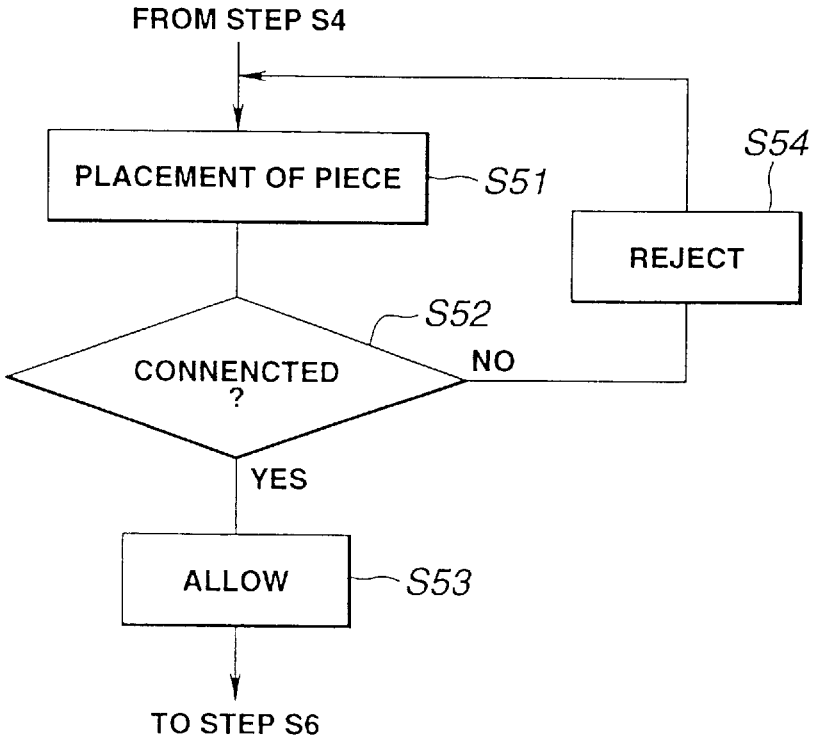
FIG. 9 is a flowchart showing a program section which can be used as a part of the program of FIG. 7.

FIG. 9 shows a program section that can be used in place of the step S5 of FIG. 7.

The control section 102 proceeds from the step S4 shown in FIG. 7 to a step S51 if the answer of the step S4 is affirmative. At the step S51, the control section 102 allows the side designated by the order signal to place a piece on a desired location on the board.

At a step S52, the control section 102 determines whether the new piece placed at the step S51 is in the connected state. If it is, the control section 102 allows the entry of the newly placed piece at a step S53, and proceeds to the next step S6. If it is not, the control section 102 rejects the newly placed piece at a step S54, and returns to the step S51. A new piece placed at a selected location is in the connected state satisfying a first predetermined arrangement condition if at least one of the horizontally and vertically adjacent locations of the selected location is occupied by at least one comrade piece of the same side.

Figure 10:
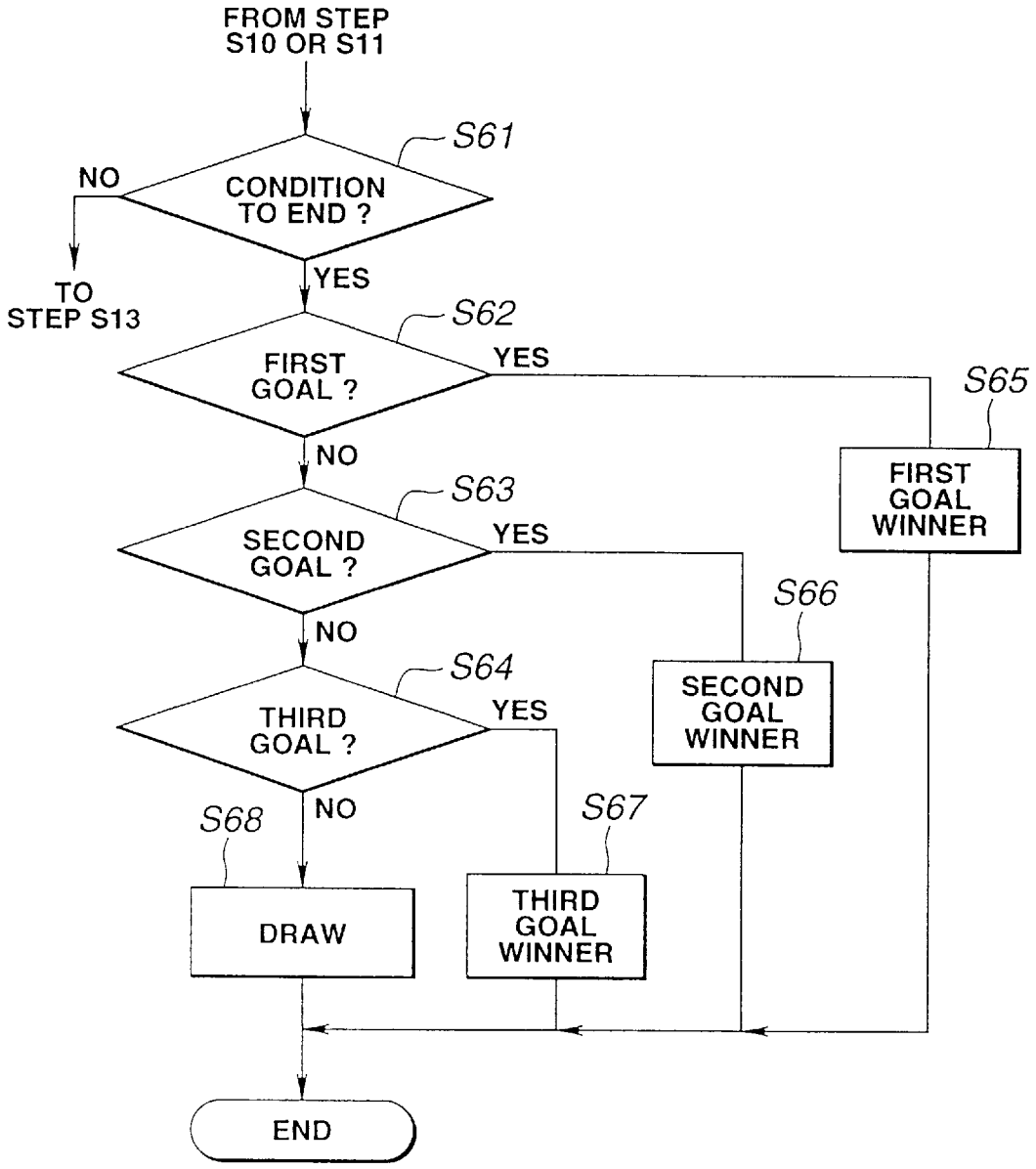
FIG. 10 is a flowchart showing a program section which can be used as another part of the program of FIG. 7.

FIG. 10 shows a program section that can be used in place of the step S12 of FIG. 7.

The control section 102 proceeds to a step S61 after the step S11 or if the answer of the step S10 is negative. At the step S61, the control section 102 determines whether at least one of game terminating conditions is satisfied. If the answer is negative, the control section 102 proceeds to the step S13 shown in FIG. 7 and continues the game.

In this example, a first game terminating condition is satisfied if either or both of the first and second sides completely occupies at least one of the horizontal and vertical rows. A second game terminating condition is satisfied if either or both of the first and second sides has used up pieces of the hand, and the hand of at least one side becomes empty. A third game terminating condition is satisfied if both sides become unable to place a piece any more on the board. Each side is unable to place a piece on the board when there remains no empty location which is horizontally or vertically adjacent to a comrade piece on the board. If at least one of the first, second and third game terminating conditions is met, the control section 102 proceeds to a step S62.

At the step S62, the control section 102 determines whether a predetermined first goal has been reached by only one of the first and second sides. The first goal is reached if at least one of the vertical and horizontal rows is occupied entirely by piece of one of the first and second sides. If neither side has reached the first goal, or if both sides have reached the first goal simultaneously, then the control section 102 proceeds to a step S63. If one of the first and second sides has reached the first goal but the other has not reached yet, then the control section 102 judges that the side who has reached the first goal is a first goal winner and wins the game at a step S65, and then terminates the game.

At the step S63, the control section 102 determines whether a predetermined second goal has been reached by only one of the first and second sides. The second goal is reached if the hand of at least one of the first and second sides becomes empty. If neither side has reached the second goal, or if both sides have reached the second goal simultaneously, then the control section 102 proceeds to a step S64. If one of the first and second sides has reached the second goal but the other has not yet attained the second goal, then the control section 102 judges that the side who has reached the second goal is a second goal winner and wins the game at a step S66, and then terminates the game.

At the step S64, the control section 102 compares the captive numbers of the first and second sides with each other, and determines whether the captive number of one side is greater than the captive number of the other. If the captive number of one side is greater than the captive number of the other, the control section 102 determines that the side having the greater captive number is a third goal winner and wins the game at a step S67. If the captive number of one side is equal to the captive number of the other, then the control section 102 determines that the game is drawn at a step 68, and terminates the game. The captive number of one side is the number of pieces of the other side captured by the one side.

It is optional to add an additional step for determining whether a predetermined number of games are completed after the steps S65~S68. In this case, after the steps S65~S68, the control section 102 proceeds to this additional step and then returns to the step S2 of FIG. 7 until the predetermined number of games are over.

Figure 11:
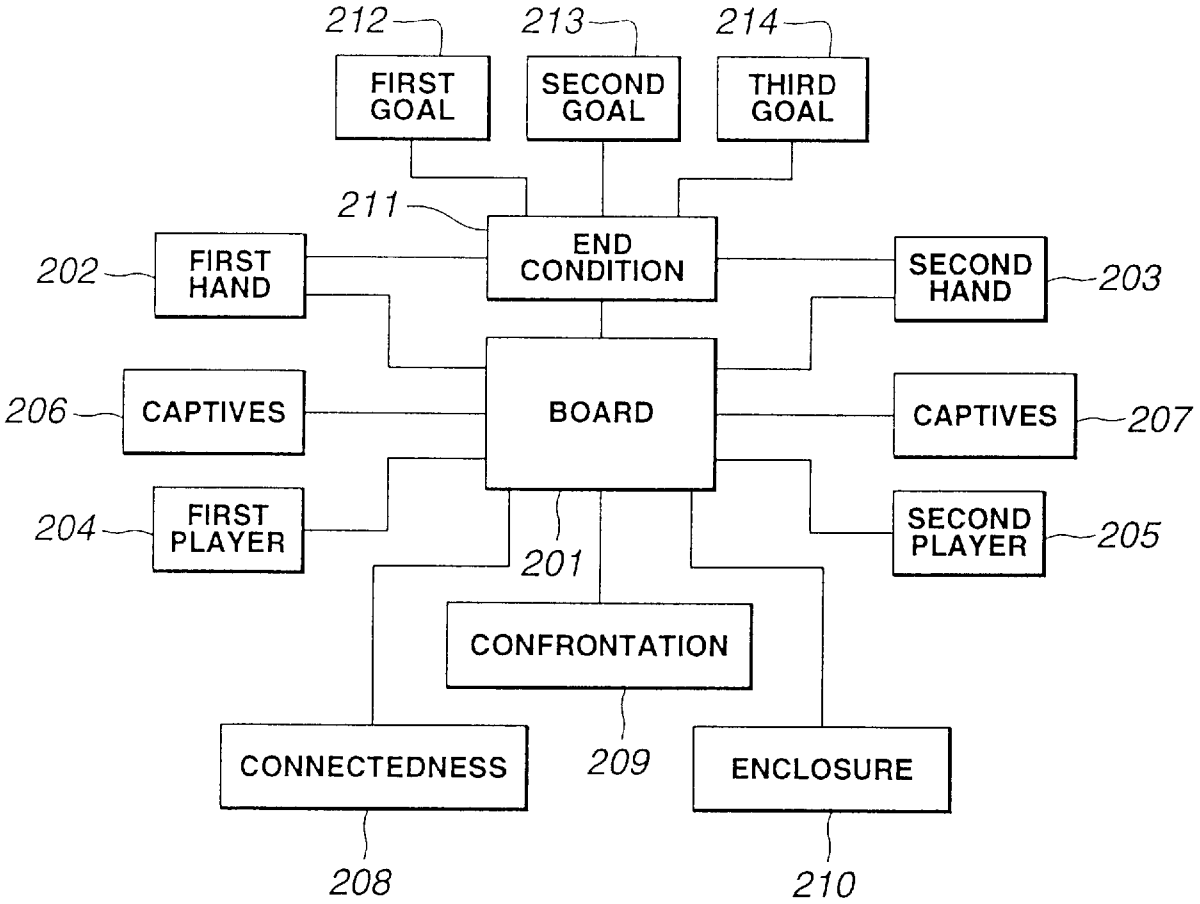
FIG. 11 is a block diagram showing, as an example, various means according to the second embodiment of the present invention.

FIG. 11 shows one example of the control section 102. In this example, the control section 102 has various functional means or subsections.

A board processing subsection 201 is for storing a collection of information items indicative of the conditions of the locations of the matrix on the board, and for controlling and displaying the board and pieces on the display screen.

A first hand processing subsection 202 is for controlling the first hand of the first side. The first hand is a subset of pieces held by the first side. The cardinal number of the subset is decreased by one each time the first side places a piece on the board. Similarly, a second hand processing subsection 203 is for controlling the second hand of the second side.

A subsection 204 for the first side is connected with the input section 103, for specifying the location of a new piece and inputting other commands from the first side. Similarly, a second player's subsection 205 is connected with the input section 103 and arranged to specify the location of a new piece and inputting other commands from the second side.

A subsection 206 controls a first side's captive subset which is a subset of pieces of the second side captured by the first side. Similarly, a subsection 207 controls a second side's captive subset which is a subset of pieces of the first side captured by the second side. At the beginning of a game, each of the captive subsets of both sides is null.

A first checking subsection 208 corresponds to the steps S52, S53 and S54 of FIG. 9. The first checking subsection 208 monitors the status of the board stored in the board processing subsection 201 and checks if a newly placed piece is in the connected state or not. A second checking subsection 209 corresponds to the steps S6~S9 of FIG. 7, monitors the board of the board processing subsection 201 and checks whether a newly placed piece is in the confronted state. A third checking subsection 210 corresponds to the step S10 and S11 of FIG. 7, monitors the status of the board and checks whether one or more pieces of either side are in the enclosed state.

A subsection 211 corresponds to the step S61, and determines whether to continue the game or not. A subsection 212 corresponds to the steps S62 and S65. A subsection 213 corresponds to the steps S63 and S66. A subsection 214 corresponds to the steps S64, S67 and S68.

It is optional to employ pieces of two different shapes. The pieces and board can be made so that each piece is held on the board by magnetic force. For example, each piece has a backside layer of magnetic rubber sheet, It is possible to implement the board game according to the present invention in the form of a computer game or video game. The game system and/or the playing process according to the present invention may be in the form of a computer-readable memory or storage medium, such as a memory device, a compact disc read only memory, or a floppy disk.

The board game according to the present invention as explained above is new, simple, easy to play, exciting, and profound.

In the case of the four-player game, the playing order is as follows. The first player of the first side (the black side, for example) plays first, the first player of the second side (the red side, for example) plays second, the second player of the first side is the third, and the second player of the second side is the fourth. In this way, the first and second sides or teams place the first and second type pieces alternately, one piece at a time. In the first embodiment, the two players of the first side (the black side, for example) and the two players of the second side (the red side, for example) preferably take seats alternately around the board 1, each play at a unique one of the four sides of the square board 1, and the four players around the board 1 play one after another in the clockwise direction. In this case, the first and second players of each of the black and red sides confront each other across the board 1.

What is claimed is:

1. A playing process for a board game, comprising:

a preparing step for preparing a game board marked with a rectangular array consisting of horizontal and vertical rows of locations, and for allocating a predetermined first set of playing pieces of a first type to a first side as a hand of the first side and a predetermined second set of playing pieces of a second type to a second side as a hand of the second side; and a playing step for alternately allowing the first and second sides to place one piece at one of the locations on the board if a newly placed piece and a piece on the board are identical in type and adjacent to each other in one of the rows.

2. A playing process according to claim 1 wherein the process further comprises a judging step for judging one side of the first and second side to be a first goal winner if one of the rows is occupied entirely by pieces of the one side.

3. A playing process according to claim 2 wherein the playing step comprises a first checking step for checking the location of a newly placed piece and adjacent locations adjacent to the location of the newly placed piece, for determining that the newly placed piece satisfies a first predetermined arrangement condition if two adjacent locations in a row are occupied by the newly placed piece and a piece which is identical in type to the newly placed piece, for accepting the newly placed piece if the first arrangement condition is satisfied and for rejecting an entry of the newly placed piece if the first condition is not satisfied.

4. A playing process according to claim 3 wherein the playing step further comprises a second checking step for checking the location of a newly placed piece and adjacent locations adjacent to the location of the newly placed piece, for determining that the newly placed piece satisfies a second predetermined arrangement condition if two adjacent locations in one of the horizontal and vertical rows are occupied by the newly placed piece and a piece which is opposite in type to the newly placed piece, and for exchanging the location of the newly placed piece with the location of the adjacent piece of the opposite type if the second arrangement condition is satisfied.

5. A playing process according to claim 4 wherein the playing step further comprises a third checking step for checking pieces on the board, determining that a piece of one type on the board satisfies a third predetermined arrangement condition if the piece of the one type on the board is enclosed by pieces of the other type, for allowing one of the sides to capture an opponent's piece on the board and instead to place one's own piece in place of the captured piece if the opponent's piece satisfies the third arrangement condition.

6. A playing process according to claim 5 wherein the judging step comprises a first determining step for determining that a first predetermined goal is reached if one of the horizontal and vertical rows is entirely occupied by pieces of one of the sides, for judging the first side to be the first goal winner if the first side has first reached the first goal, and for judging the second side to be the first goal winner if the second side has first reached the first goal.

7. A playing process according to claim 6 wherein the judging step further comprises a second determining step for determining that a second predetermined goal is reached by one of the sides if the hand of one side becomes empty, for judging the first side to be a second goal winner if the first side has first used up the hand of the first side, and for judging the second side to be the second goal winner if the second side has first used up the second hand of the second side.

8. A playing process according to claim 7 wherein the judging step further comprises a third determining step for determining that a third predetermined goal is first reached by the first side and the first side is a third goal winner if both sides become unable to place a piece on the board, and a first captive number which is a number of pieces captured by the first side is greater than a second captive number which is a number of pieces captured by the second side, and for determining that the third goal is first reached by the second side and the second side is the third goal winner if both sides become unable to place a piece on the board, and the second captive number is greater than the first captive number.

9. A playing process according to claim 8 wherein the preparing step comprises an initializing step for placing a predetermined number of pieces of the first and second types, respectively, at predetermined locations on the board before the playing step.

10. A playing process according to claim 9 wherein the judging step further comprises a fourth determining step for determining that the first goal winner is a game winner if one side becomes the first goal winner and simultaneously the other side becomes the second goal winner.

11. A playing process according to claim 10 wherein the judging step further comprises a fifth determining step for determining the first side to be the game winner if the first and second sides become the first goal winner simultaneously and the first captive number is greater than the second captive number, for determining the second side to be the game winner if the first and second sides become the first goal winner simultaneously and the second captive number is greater than the first captive number, for determining the first side to be the game winner if the first and second sides become the second goal winner simultaneously and the first captive number is greater than the second captive number, and for determining the second side to be the game winner if the first and second sides become the second goal winner simultaneously and the second captive number is greater than the first captive number.

12. A playing process according to claim 1:

wherein the judging step further comprises a sixth determining step for terminating a game if one of first, second and third game terminating conditions is satisfied, the first game terminating condition being satisfied when at least one of the horizontal and vertical rows is entirely occupied by at least one of the first and second sides, the second game terminating condition being satisfied if at least one of the hands of the first and second sides becomes empty, the third game terminating condition being satisfied if both of the first and second sides become unable to place a piece on the board;

wherein, in the first checking step, the first predetermined arrangement condition is satisfied by a new piece and a placement of the new piece at a selected location is allowed if the selected location is empty before the placement of the new piece, and at least one of adjacent locations adjacent to the selected location is occupied by a comrade piece, the selected location being one of the locations of the rectangular array, each adjacent location being located directly next to the selected location in one of the horizontal and vertical rows, the comrade piece being one of the pieces which are identical in type to the new piece;

wherein, in the second checking step, the new piece placed at the selected location satisfies the second predetermined arrangement condition and a replacement of the new piece and an adjacent enemy piece with each other is required if at least one of the adjacent locations adjacent to the selected location is occupied by at least one of enemy pieces which are pieces opposite in type to the new piece, the adjacent enemy piece being one of the enemy pieces located in one of the adjacent locations adjacent to the selected location;

wherein the third checking step comprises an operation for allowing one of the first and second sides to capture a group of enemy pieces on the board if the group of the enemy pieces are completely surrounded by comrade pieces and there are no empty adjacent locations.

13. A playing process according to claim 12 wherein the rectangular array is defined by horizontal and vertical straight lines, each location is defined by a rectangle, and each rectangle is adapted to receive only one piece.

14. A playing process according to claim 13 wherein the rectangular array is a square array, and the rectangle of each location is a square;

wherein the array is a 10×10 array having ten of the vertical rows and ten of the horizontal rows, the first set includes 60 of the pieces of the first type and the second set includes 59 of the pieces of the second type;

wherein the pieces of the first type are black pieces and the pieces of the second type are red pieces; and wherein two of the locations are first initial locations and two of the locations are second initial locations, the initializing step comprises an operation for allowing the first side to place two of the pieces of the first type at the first initial locations and the second side to place two of the pieces of the second type at the second initial locations before the playing step, the first and second initial locations are spaced from one another and arranged in a square symmetrically around a center of the square array on the board, the first initial locations are diagonally opposite to each other, and the second initial locations are diagonally opposite to each other in the square formed by the first and second initial locations.

15. A game board system comprising:

a first section for preparing a game board marked with a rectangular array consisting of horizontal and vertical rows of locations, a first hand consisting of a first set of first type playing pieces for a first player side and a second hand consisting of a predetermined second set of second type playing pieces for a second player side; and a second section for repeating a cycle comprising a first operation for allowing the first side to place one of the pieces of the first hand at an empty one of the locations of the rectangular array on the board if the piece placed by the first side is in a connected state and a second operation for allowing the second side to place one of the pieces of the second hand at an empty one of the locations of the rectangular array on the board if the piece placed by the second side is in the connected state, and for judging one side to be a first goal winner if one of the horizontal and vertical rows is occupied entirely by pieces of the one side wherein each of two pieces on the board are in the connected state if the locations occupied by the two pieces are adjacent to each other in one of the horizontal and vertical rows and the two pieces are of one of the first and second types.

16. A board game system according to claim 15 wherein the first section comprises a display device, the second section comprises a control section for controlling the first section, and the system further comprises a third section for allowing each side to command the control section to place a piece on the board.

17. A board game system according to claim 16:

wherein the control section is configured to check an entry that is a piece placed at a location by one of the first and second side, to determine that the entry is in a confronted state if there is an adjacent opposing neighbor that is a piece opposite in type to the entry, and placed at an adjacent location adjacent to the location of the entry, to replace the entry and the adjacent opposing neighbor with each other if the entry is in the confronted state with the adjacent opposing neighbor; and wherein the control section is configured to check pieces on the board, to determine that an object that is a piece on the board is in an enclosed state if all of the adjacent locations adjacent to the location of the object are occupied by pieces opposite in type to the object, to allow the side opposite to the object to capture the object and remove the object from the board if the object is in the enclosed state, and to allow the side opposite to the object to place a piece opposite in type to the object in place of the object.

18. A board game system according to claim 17:

wherein the control section is configured to check an entry that is a piece placed at a location by one of the first and second side, to determine that the entry is in the confronted state if there are adjacent opposing neighbors each of which is a piece opposite in type to the entry, and placed at an adjacent location adjacent to the location of the entry, to replace the entry and a selected one of the adjacent opposing neighbor with each other if the entry is in the confronted state with the adjacent opposing neighbors;

wherein the control section is configured to check pieces on the board, to determine that a connected group of pieces which are in the connected state with one another is in the enclosed state if all of unconnected adjacent locations of the group are occupied by pieces opposite in type to the pieces of the connected group, to allow all the pieces of the connected group to be captured, removed from the board and entered into a captive group of the side opposite to the side of the connected group if the connected group is in the enclosed state, and to allow pieces opposite in type to the connected group to be placed in place of the connected group;

wherein the control section is configured to determine that a first predetermined goal is reached if one of the horizontal and vertical rows is entirely occupied by pieces of one type, to judge that the first side is a first goal winner if the first side has first reached the first goal and that the second side is the first goal winner if the second side has first reached the first goal;

wherein the control section is configured to determine that a second predetermined goal is reached by one side if the hand of one side becomes empty, to judge that the first side is a second goal winner if the first side has first used up the first hand, and that the second side is the second goal winner if the second side has first used up the second hand; and wherein the control section is configured to determine that a third predetermined goal is first reached by the first side and the first side is a third goal winner if both sides become unable to place a piece on the board, and a first captive number which is a number of pieces captured by the first side is greater than a second captive number which is a number of pieces captured by the second side, and to determine that the third goal is first reached by the second side and the second side is the third goal winner if both sides become unable to place a piece on the board, and the second captive number is greater than the first captive number.

* * * * *